US007520071B2

(12) United States Patent
Abramson

(10) Patent No.: US 7,520,071 B2
(45) Date of Patent: Apr. 21, 2009

(54) FOLDING TOWER DISPLAY

(75) Inventor: Mark Abramson, Chicago, IL (US)

(73) Assignee: Rapid Displays, Inc., Chicago, IL (US)

( * ) Notice: Subject to any disclaimer, the term of this patent is extended or adjusted under 35 U.S.C. 154(b) by 169 days.

(21) Appl. No.: 11/202,699

(22) Filed: Aug. 12, 2005

(65) Prior Publication Data

US 2007/0033842 A1 Feb. 15, 2007

(51) Int. Cl.

| | |
|---|---|
| ***G09F 1/08*** | (2006.01) |
| ***G09F 1/00*** | (2006.01) |
| ***G09F 7/00*** | (2006.01) |
| ***A47G 1/16*** | (2006.01) |

(52) U.S. Cl. ..... 40/538; 40/539; 40/605; 40/610; 40/124.16; 40/124.14; 40/124.07; 40/124.09; 40/124.191

(58) Field of Classification Search ..... 40/538, 40/539, 611.05, 606.01, 610, 606.12, 754, 40/124.19, 611.01, 124.16, 124.14, 750, 40/124.07, 124.09, 124.191, 605; 446/148; 1/538, 539, 124.16, 124.14, 750, 124.07, 1/124.09, 124.19, 124.191, 610, 605

See application file for complete search history.

(56) References Cited

U.S. PATENT DOCUMENTS

| | | | | |
|---|---|---|---|---|
| 693,427 | A | 2/1902 | Easel | |
| 1,576,672 | A | 3/1926 | Miller | |
| 1,817,598 | A | 8/1931 | Zimmerman | |
| 1,822,297 | A | 9/1931 | Kemery | |
| 2,025,280 | A | 12/1935 | Gregg | |
| 2,070,054 | A | 2/1937 | Lehman | |
| 2,080,105 | A | 5/1937 | Bacon | |
| 2,113,288 | A | 4/1938 | Berger | |
| 2,283,406 | A | 5/1942 | Bacon | |
| 2,290,144 | A | 7/1942 | Katz | |
| 2,373,778 | A * | 4/1945 | Quinby | 40/605 |
| 2,677,469 | A | 5/1954 | Ebert | |
| 2,723,820 | A | 11/1955 | Schulz et al. | |
| 2,918,178 | A | 12/1959 | Leone | |
| 2,920,410 | A * | 1/1960 | Angehrn | 40/539 |
| 3,057,095 | A * | 10/1962 | Foreman | 40/800 |
| 3,139,255 | A | 6/1964 | Palm | |
| 3,231,996 | A | 2/1966 | Krauss | |
| 3,420,362 | A | 1/1969 | Kleingers, Jr. | |
| 3,508,734 | A | 4/1970 | Thomas | |
| 3,533,584 | A | 10/1970 | Rohrbach | |

(Continued)

*Primary Examiner*—Paul N Dickson
*Assistant Examiner*—Syed A Islam
(74) *Attorney, Agent, or Firm*—DLA Piper LLP (US); Jennifer E. Lacroix

(57) ABSTRACT

A folding display includes a tower member having a display panel with advertising indicia on a front surface and a support panel attached to the back surface. The display and support panels feature lateral fold lines so that the tower member may be folded for shipping and storage. The support panel has a pair of flaps formed therein and each flap features an arcuate surface. The flaps may be moved into a position where the arcuate surfaces engage the back surface of the display panel so that it assumes a convex configuration. The tower display is then capable of standing on a generally horizontal surface. A pair of the tower displays may be positioned in spaced relation with a bridge member, also featuring advertising indicia, extending between them. A base member lays on the surface upon which the display is standing and features end portions that engage the tower members.

14 Claims, 6 Drawing Sheets

U.S. PATENT DOCUMENTS

| | | | | | |
|---|---|---|---|---|---|
| 3,837,719 | A | | 9/1974 | Barron | |
| 4,506,790 | A | | 3/1985 | Muscari | |
| 4,512,541 | A | | 4/1985 | Lietzke | |
| 4,646,922 | A | | 3/1987 | Smith | |
| 4,759,520 | A | * | 7/1988 | Levine | 248/174 |
| 4,760,928 | A | | 8/1988 | Bustos | |
| 4,991,813 | A | | 2/1991 | Beaulieu | |
| 5,787,621 | A | * | 8/1998 | Leksell | 40/607.03 |
| 5,803,205 | A | | 9/1998 | Kochem | |
| 5,983,545 | A | * | 11/1999 | Marco | 40/610 |
| 6,012,585 | A | | 1/2000 | Parker | |
| 6,347,772 | B1 | | 2/2002 | L'Hotel | |
| 6,363,640 | B1 | * | 4/2002 | Flum et al. | 40/539 |
| 6,382,433 | B1 | | 5/2002 | Podergois | |
| 6,474,483 | B1 | | 11/2002 | Montoya et al. | |
| 6,488,245 | B1 | | 12/2002 | Maglione | |
| 6,804,905 | B1 | * | 10/2004 | Burger et al. | 40/610 |
| 7,159,351 | B2 | * | 1/2007 | Sparkowski | 40/610 |
| 2002/0104244 | A1 | * | 8/2002 | Moss et al. | 40/610 |
| 2002/0175133 | A1 | | 11/2002 | Hiltke et al. | |
| 2003/0145499 | A1 | * | 8/2003 | Tarter et al. | 40/610 |
| 2004/0011753 | A1 | | 1/2004 | Field et al. | |
| 2004/0245413 | A1 | | 12/2004 | Dempsey | |
| 2005/0086842 | A1 | * | 4/2005 | Ternovits et al. | 40/539 |

* cited by examiner

FOLDING TOWER DISPLAY

BACKGROUND OF THE INVENTION

The present invention relates generally to displays and, more specifically, to a folding tower display.

Various constructions are known for displays used in supermarkets or other retail establishments for displaying articles or goods on sale. Such displays are often used as more attractive alternatives to just merely stacking the articles on top of one another, or displaying them in partially cut-off original cartons or boxes. The displays are often fabricated from plastic or paperboard materials. They may be designed to be quickly set up and knocked down in order to accommodate the needs of the particular business establishment as well as the changing promotional events that prompt the use of the display. Such displays may also find use at trade shows and in other venues or establishments.

One type of display features a tower-shaped main body that is constructed of cardboard or corrugated paperboard and features a convex display panel. Such displays are advantageous in that they provide a three-dimensional display that may be viewed through a wide range of angles. In addition, such displays typically are self-supporting in that a separate stand is not required. The displays typically also fold flat for ease of shipping and storage.

An example of a prior art folding display featuring a convex display panel is illustrated in U.S. Pat. No. to 6,347,772 to L'Hotel. The L'Hotel '772 patent illustrates a display featuring a tower-shaped main body constructed from a single piece of cardboard. The body includes a display panel that is divided by lateral fold lines into four segments. Each segment features opposing side edges with a side panel extending from one side edge and a corresponding tab extending from the opposing side edge. When the display panel is unfolded, the side panels and tabs of the segments are folded back behind the display panel in an overlapping fashion. Rubber bands engage holes formed in each side panel and corresponding tab and urge the side panels and tabs into further overlapping engagement. As a result, the display panel flexes into a convex shape. The tension of the rubber bands is such that the display remains flat when folded. When the display panel is held by the top end, however, and the display panel segments are permitted to unfold via gravity, the rubber bands cause the display panel to automatically flex and lock into the convex configuration.

While the display of the L'Hotel '772 patent works well, the rubber bands may eventually break or dry up and cease to function. In addition, they add to the complexity of the display and could tear through the cardboard so as to adversely effect durability.

Other examples of prior art folding displays featuring convex display panels are presented in U.S. Pat. Nos. 1,576,672 to Miller, 2,283,406 to Bacon and 2,290,144 to Katz. Each of these patents discloses a display that features a tower-shaped hollow main body constructed of a flat panel joined by opposing side edges to the opposing side edges of a convex panel. Each display also features a pair of generally semicircular flaps that are attached by their flat edges to the interior surface of the main body flat panel. The flaps may be positioned so that the display is collapsed and in a flattened configuration for shipping or storage. To deploy the display, the flaps are moved into positions where their curved edges engage the interior surface of the convex panel.

A disadvantage of the displays of the Miller '672, Bacon '406 and Katz '144 patents, however, is that the panels that make up the body of each display do not feature transverse fold lines. As a result, the displays can't be folded to decrease their height or length. This limits the practical height for each display and increases the space required for shipping and storage.

A further disadvantage of the displays of the patents recited above is that they are not designed to easily accommodate bridge members. More specifically, it may be desirable to position two of the tower-like displays in spaced relation with merchandise stacked between them. In such a scenario, it is advantageous for a bridge member to be attached by opposing ends to the tops of the displays so that it passes over the merchandise. This is because the bridge member provides additional space for displaying advertising messages or the like and gives the overall display an integrated and eye-catching appearance.

Accordingly, it is an object of the present invention to provide a display that folds into a compact configuration for ease of storage and shipping.

It is another object of the present invention to provide a folding display that is quick and easy to set up.

It is another object of the present invention to provide a folding display that is stable.

It is still another object of the present invention to provide a folding display that is economical to produce.

These and other objects and advantages will be apparent from the following specification.

SUMMARY OF THE INVENTION

The present invention is a folding display that includes a tower member featuring a display panel having a front surface and a back surface. The front surface is provided with advertising indicia. A support panel features a pair of side tabs with a pair of flaps positioned between the side tabs. Each of the flaps has an arcuate edge. The side tabs of the support panel are secured to the back surface of the display panel. The flaps of the support panel are movable to positions where their arcuate edges engage the back surface of the display panel so that the display panel is placed in a convex configuration. The tower member is capable of standing on a generally horizontal surface when in this display configuration. The flaps may be moved out of engagement with the display panel so that the support panel lays flat against the back surface of the display panel. The display and support panels feature fold lines so that the tower member may then be folded for ease of shipping or storage.

A pair of the tower members may be positioned in a spaced relation with their support panels facing one another and a bridge member engaging the upper flaps of the support panels. More specifically, the bridge member features a pair of panels joined by hinges. The panels also feature advertising indicia and are oriented so that they form an A-frame shaped structure. Each of the bridge member panels features a pair of tabs. The tabs engage slots formed on the upper flaps of the support panels of the tower members. As a result, the bridge member spans between the tower members. In addition, a base member may be positioned between the tower members on the surface upon which the display is supported. The base member features upturned end portions so that it has a generally U-shaped configuration. The end portions of the base member engage the tower members.

The following detailed description of embodiments of the invention, taken in conjunction with the appended claims and accompanying drawings, provide a more complete understanding of the nature and scope of the invention.

DESCRIPTION OF THE PREFERRED EMBODIMENT

Figure 1:
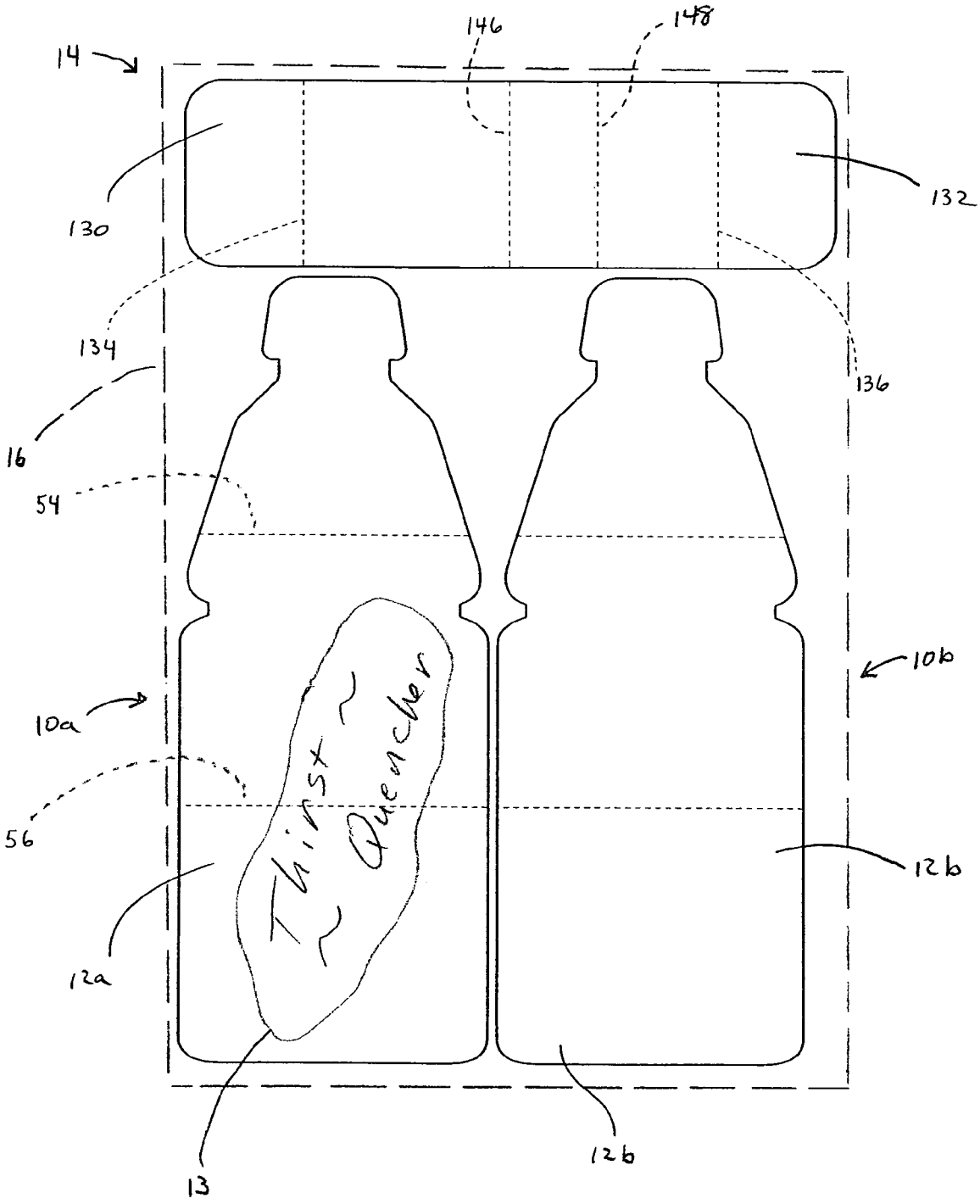
FIG. 1 is a top plan view of a sheet featuring the display panels and base member of a preferred embodiment of the display of the present invention.

With reference to FIG. 1, a preferred embodiment of the display of the present invention features a pair of display panels, indicated in general at 10*a* and 10*b*. Each display panel features a front surface, illustrated at 12*a* and 12*b*, that preferably is provided with colorful advertising indicia or graphics, as illustrated at 13. The display panels also may feature an eye-catching or whimsical shape, such as the shape of a bottle as illustrated in FIG. 1. The display also includes a base member, indicated in general at 14 in FIG. 1. The display panels and base member are preferably cut from a single sheet of cardboard, indicated in phantom at 16. Sheet 16 may be constructed from a variety of alternative flexible and foldable materials including, but not limited to, paperboard, corrugated cardboard or plastic.

Figure 2:
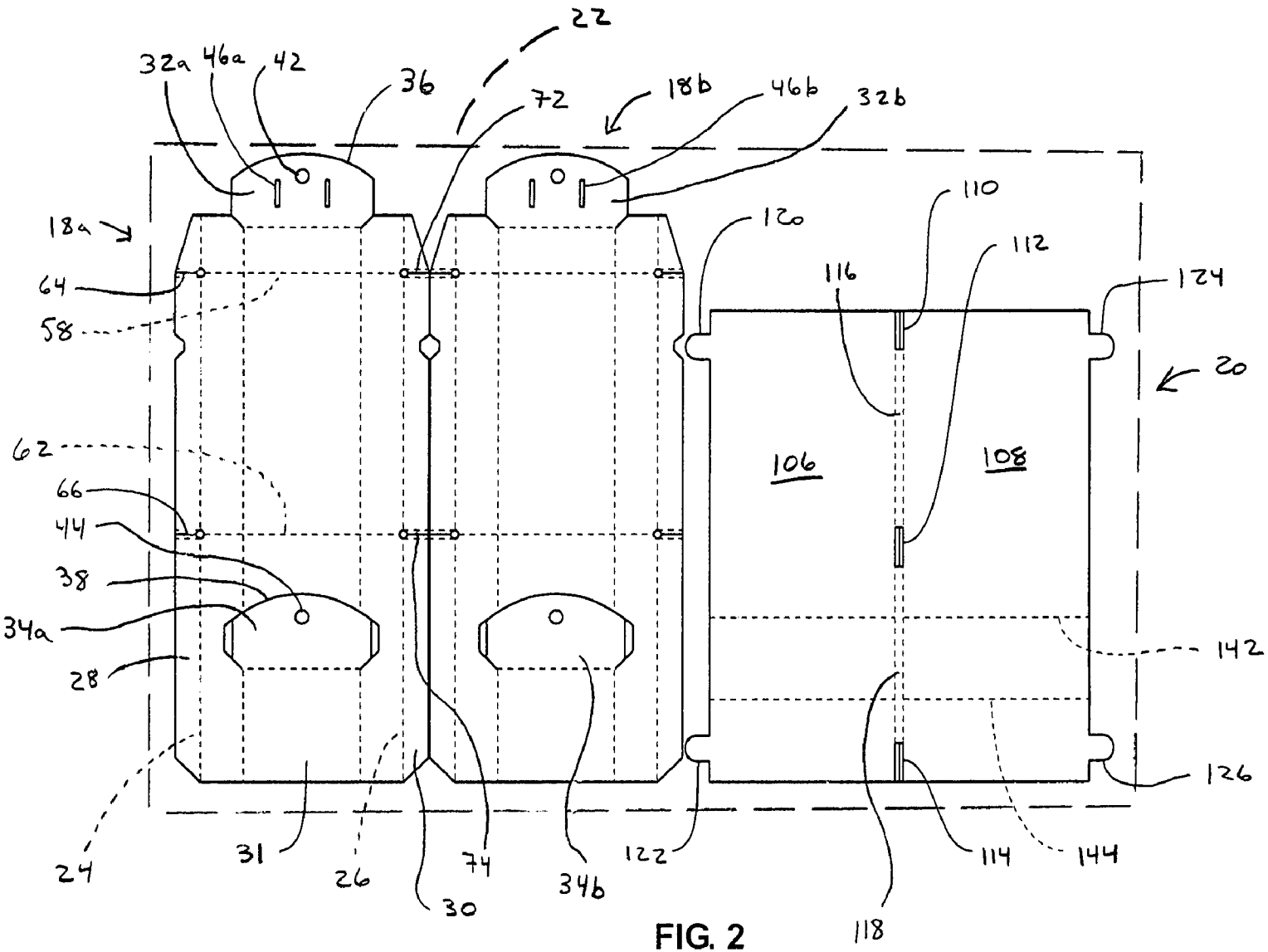
FIG. 2 is a top plan view of a sheet featuring the support panels and bridge member of the preferred embodiment of the display of the present invention.

The preferred embodiment of the display also features a pair of support panels, indicated in general at 18*a* and 18*b* in FIG. 2, as well as a bridge member, indicated in general at 20. As with the components of FIG. 1, the support panels and bridge member of FIG. 2 preferably are cut from a single sheet of material, indicated in phantom at 22. The material used for sheet 22, however, is preferably corrugated cardboard for added rigidity. Sheet 22 of FIG. 2 may be constructed from a variety of alternative foldable materials including paperboard, standard cardboard or plastic.

As illustrated in FIG. 2, support panel 18*a* features longitudinal fold lines 24 and 26 which define an opposing pair of elongated side tabs 28 and 30. In addition, support panel 18*a* features a back portion 31, an upper flap 32*a* and a lower flap 34*a*. Upper flap 32*a* features an arcuate edge 36 while lower flap 34*a* features arcuate edge 38. Upper and lower flaps 32*a* and 34*a* are also both provided with finger holes 42 and 44, respectively. In addition, upper flap 32*a* is provided with a pair of parallel slots 46*a*, the function of which will be explained below. Support panel 18*b* includes upper flap 32*b*, lower flap 34*b* and otherwise features a construction that is identical to support panel 18*a*.

Figure 3:
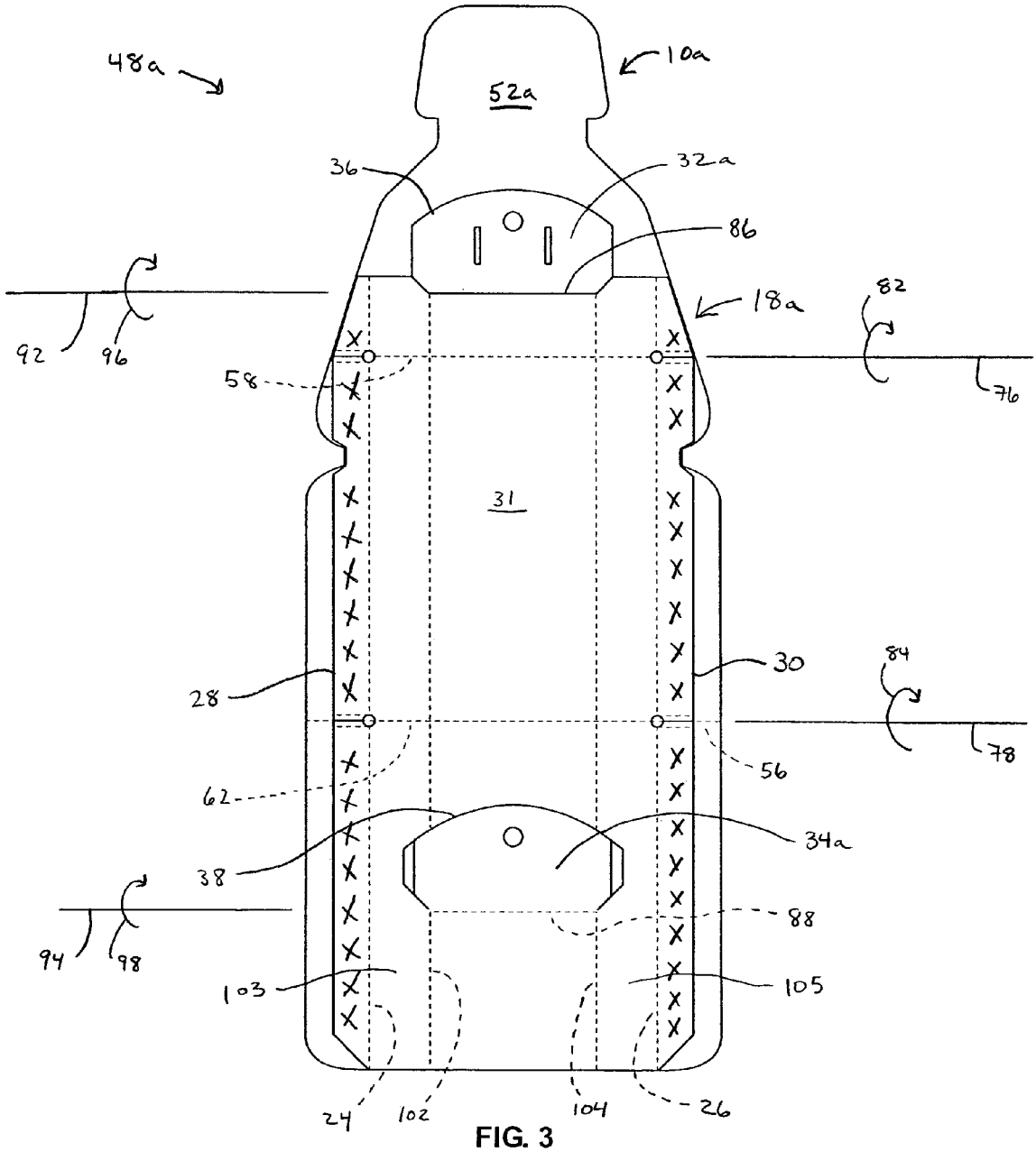
FIG. 3 is a rear elevational view of a tower member assembled from a display panel of FIG. 1 and a support panel of FIG. 2 with the flaps of the support panel positioned so that the tower member is in a flat configuration.

A tower member assembled using component from FIGS. 1 and 2 is indicated in general at 48*a* in FIG. 3. More specifically, the tower member is constructed by attaching the elongated side tabs 28 and 30 of support panel 18*a* of FIG. 2 to the back side 52*a* of display panel 10*a* of FIG. 1. This preferably is accomplished using adhesive, but other attachment methods may be used including, but not limited to, staples or tape. As a result, when flaps 32*a* and 34*a* lay in the same plane as the back portion 31 of the support panel 18*a*, the support panel 18*a* lays flat against the flat display panel 10*a* so that the tower member 48*a* is in a flat configuration.

As indicated in FIG. 1, display panel 10*a* is provided with upper lateral fold line 54 and lower lateral fold line 56. Display panel 10*b* of FIG. 1 features similar upper and lower lateral fold lines. In addition, as illustrated in FIG. 2, support panel 18*a* is also provided with an upper lateral fold line, which takes the form of upper lateral cut or slit 58, that extends between longitudinal fold lines 24 and 26. Support panel 18*a* is also provided with a lower lateral fold line, which takes the form of lower lateral cut or slit 62, that also extends between longitudinal fold lines 24 and 26. The elongated side tab 28 of support panel 18*a* is provided with lateral fold lines 64 and 66 while tab 30 is provided with lateral fold lines 72 and 74. Support panel 18*b* features similar cuts or slits and fold lines. It should be noted that slits or cuts are preferable for lateral fold lines 58 and 62 when support panel 18*a* is constructed of corrugated cardboard. If the support panels are made of a thinner material, such as regular cardboard, mere folds will suffice in place of cuts or slits for the lateral fold lines.

When the tower member is assembled, as illustrated in FIG. 3, the upper and lower fold lines of the display panel 10*a* are overlaid by the upper and lower cuts or slits 58 and 62 and fold lines 64, 66, 72 and 74 of the support panel 18*a*. As a result, tower member 48*a* may be folded about axes 76 and 78 of FIG. 3 as illustrated by arrows 82 and 84. This permits the tower display to be folded into a compact configuration for ease of storage or shipping.

Figure 4:
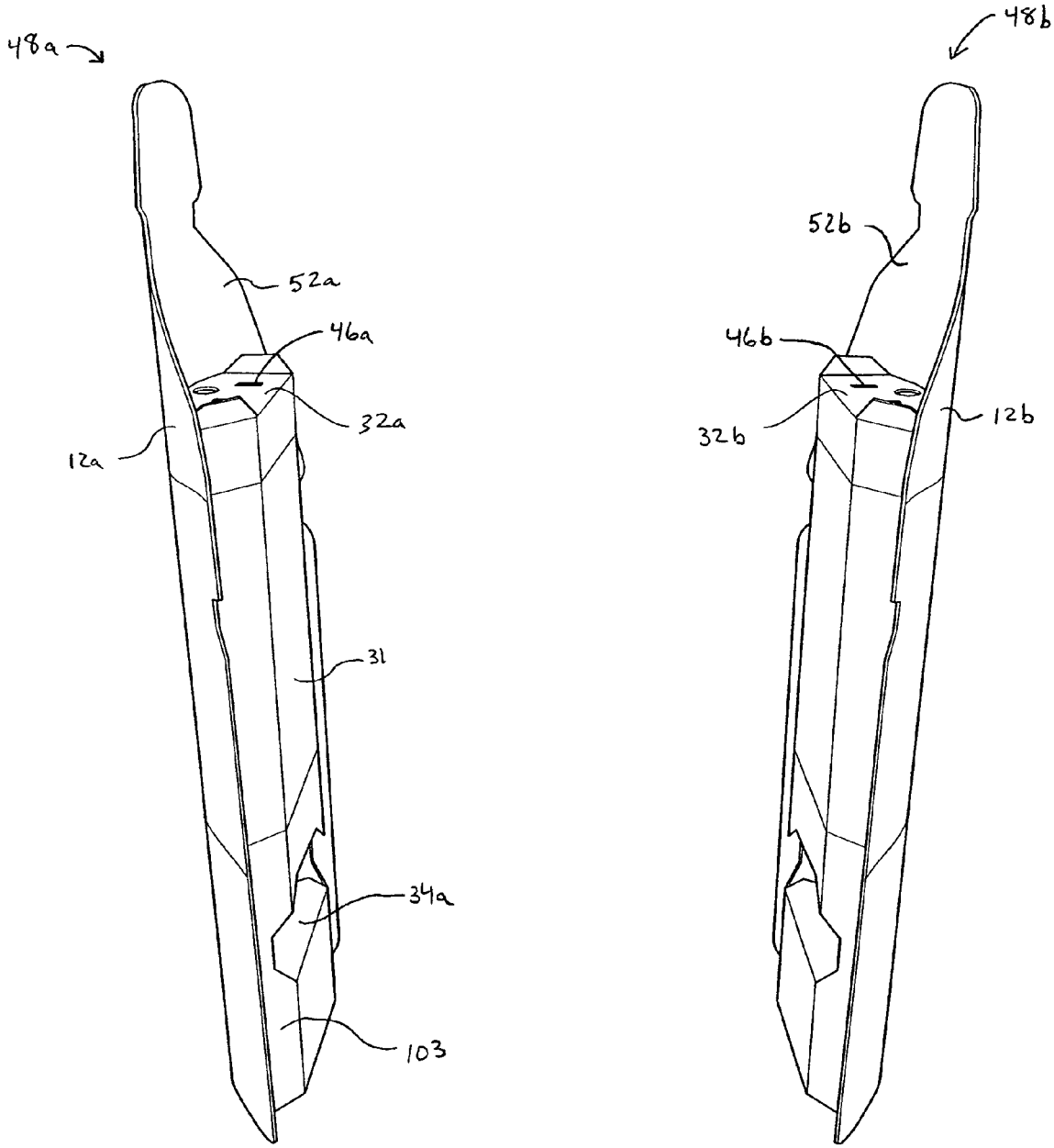
FIG. 4 is a perspective view of two tower members assembled from the display panels of FIG. 1 and the support panels of FIG. 2 with the flaps of the support panels positioned so that the tower members are each in a deployed configuration.

The tower member 48*a* of FIG. 3 may be placed in a deployed configuration, illustrated in FIG. 4, by folding flaps 32*a* and 34*a* at fold lines 86 and 88 (FIG. 3) about axes 92 and 94 in the direction indicated by arrows 96 and 98 so that they both lay in planes that are perpendicular to the plane of the back portion 31 of support panel 18*a*. This causes the arcuate edge 36 of upper flap 32*a* (FIG. 3) and the arcuate edge 38 of lower flap 34*a* to engage the back surface 52*a* of display panel 10*a* so that display panel 10*a* is bowed into a convex configuration, as illustrated in FIG. 4. As the flaps 32*a* and 34*a* are folded into the position shown in FIG. 4, the support panel 18*a*, with reference to FIG. 3, folds about longitudinal fold lines 24 and 26 as well as about longitudinal fold lines 102 and 104. Finger holes 42 and 44 (FIG. 3) may be used to return the flaps to their initial position where the tower member is in the flat configuration.

As illustrated in FIG. 3, support panel side portion 103 is defined between fold lines 24 and 102 while side portion 105 is defined between fold lines 26 and 104. As a result, when in the deployed configuration illustrated in FIG. 4, the side portions 103 and 105 form an angle with the back portion 31 of the support panel. The bottom edges of the angled side portions cooperate with the bottom edges of the convex display panel and the back portion 31 of the support panel so that the display member may stand on a horizontal surface, as illustrated in FIG. 4.

The display panel 10*b* of FIG. 1 and the support panel 18*b* of FIG. 2 may be assembled in the same fashion as described above for tower member 48*a* so that a second tower member, indicated in general at 48*b* in FIG. 4 is formed. Tower member 48*b* may also be collapsed from the deployed configuration into a flat configuration, as illustrated for tower member 48*a* in FIG. 3, so that it may also be folded into a compact configuration for ease of storage or shipping.

An embodiment of the display of the present invention is assembled by first placing the two tower members 48*a* and 48*b*, as illustrated in FIG. 4, in spaced relation with the front surfaces 12*a* and 12*b* of the convex display panels facing outward and the back surfaces 52*a* and 52*b* facing inward and each other. The tower members 48*a* and 48*b* are now positioned so that the bridge member 20 of FIG. 2 and the base member 14 of FIG. 1 may be attached thereto.

Figure 5:
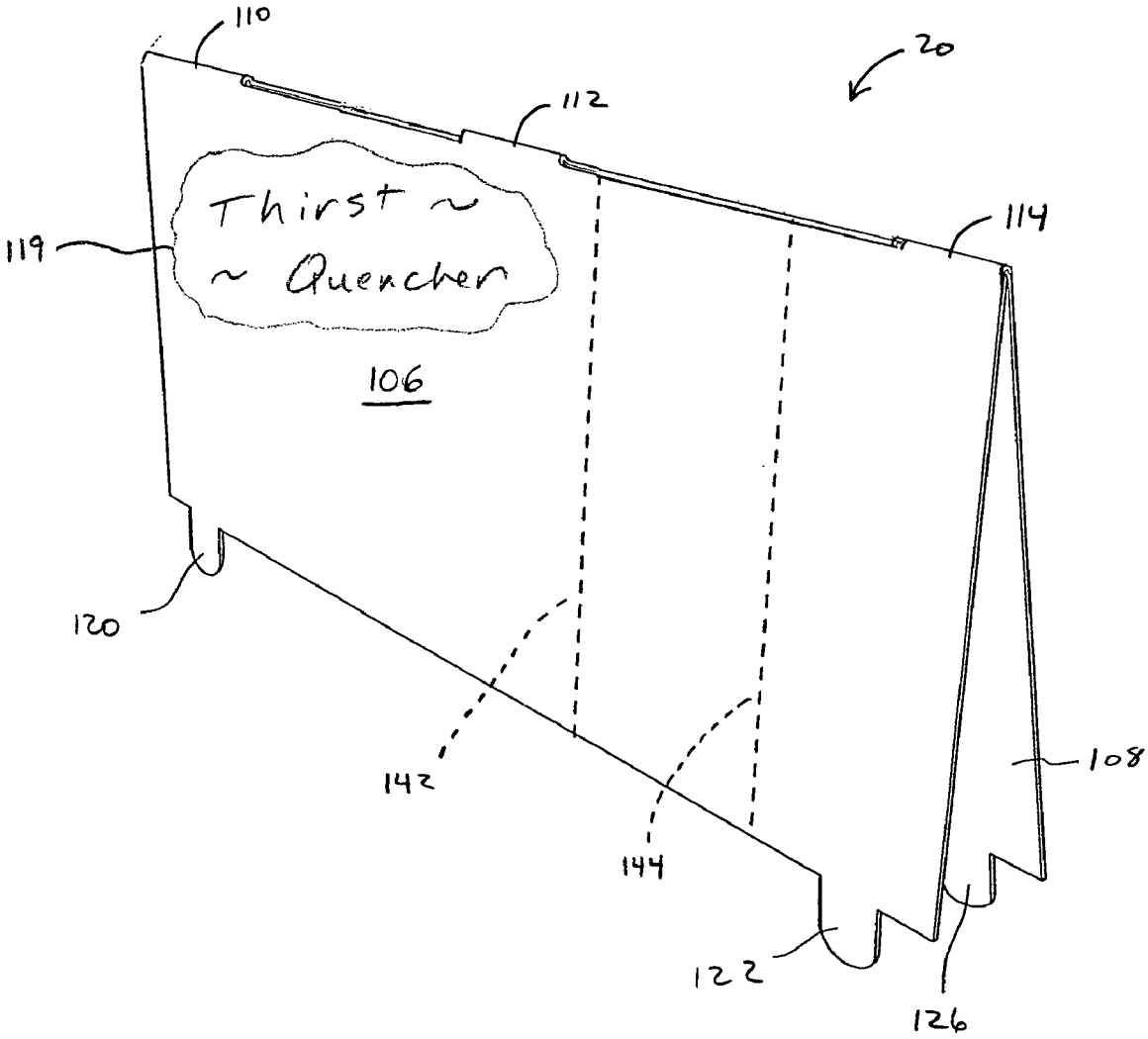
FIG. 5 is a perspective view of the bridge member of FIG. 2 folded and ready for attachment to the tower members of FIG. 4.

With reference to FIG. 2, the bridge member 20 features a first panel 106 joined to a second panel 108 by hinges formed at 110, 112 and 114. Hinges 110, 112 and 114 may be formed by removing two thin strips of material from the bridge member at 116 and 118. Fold lines are then formed along each hinge. First and second panels 106 and 108 preferably feature colorful or otherwise eye-catching advertising messages or artwork, illustrated at 119 in FIG. 5. Tabs 120 and 122 extend from panel 106 and tabs 124 and 126 extend from second panel 108. The bridge member 20 of FIG. 2 is prepared for use by folding panels 106 and 108 towards one another about hinges 110, 112 and 114, as illustrated in FIG. 5. As a result, an "A-frame" type structure is formed.

Figure 6:
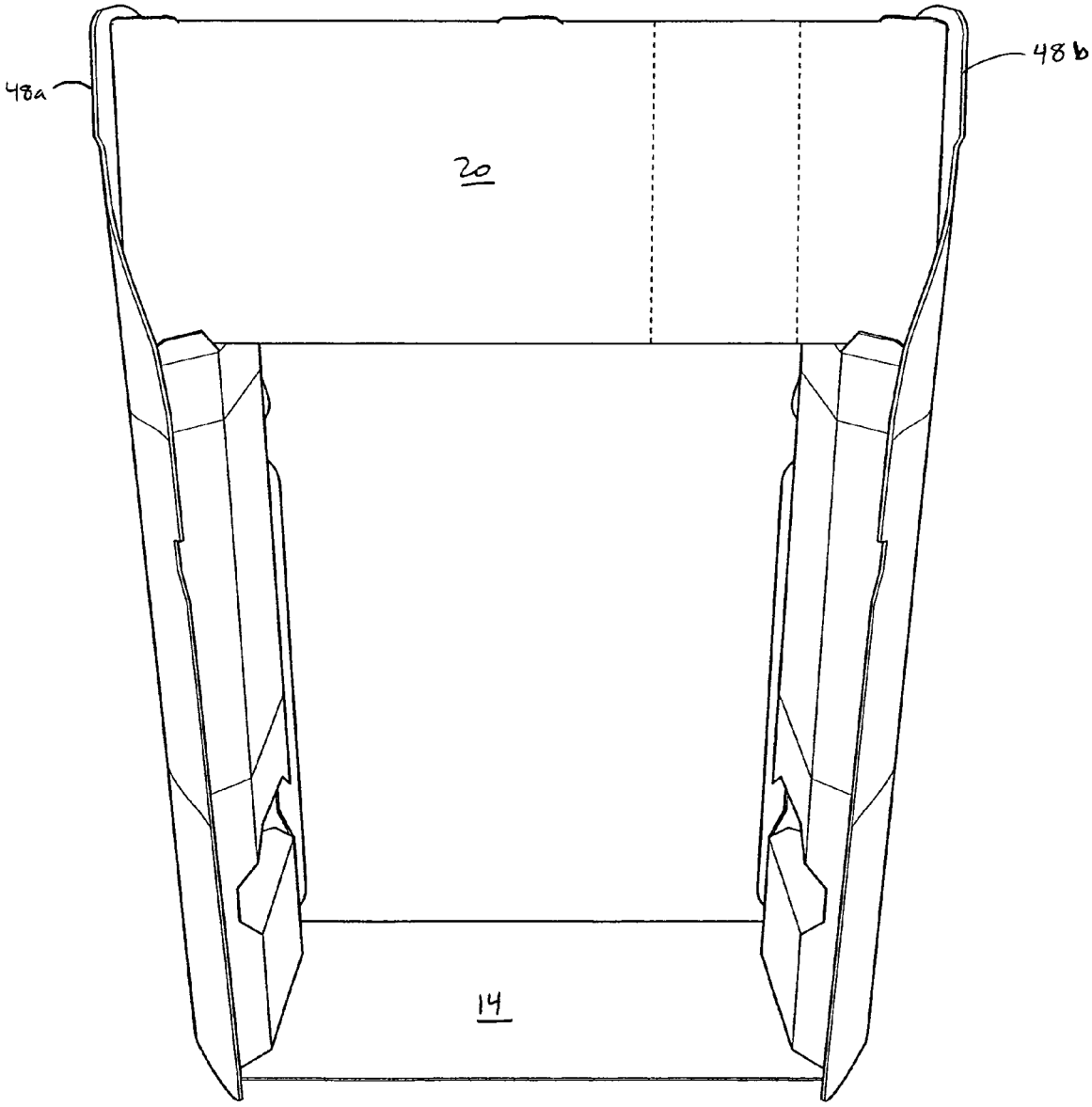
FIG. 6 is a perspective view of the bridge member of FIG. 5 and the base member of FIG. 1 attached to the tower members of FIG. 4.

Next, the tabs 120, 122, 124 and 126 of bridge member 20 of FIG. 5 are inserted into the slots 46*a* and 46*b* of the flaps 32*a* and 32*b* of tower members 48*a* and 48*b* of FIG. 4 so that the bridge member 20 spans between the tower members, as illustrated in FIG. 6. As a result, the bridge member 20 is supported by the flaps with the opposing ends of the bridge member 20 also abutting the back surfaces of the convex display panels. Bridge member 20 also locks the display members 48*a* and 48*b* into their spaced relation.

The base member 14 of FIG. 1 features a pair of end portions 130 and 132 that are connected to the remaining portion of the base member by lateral fold lines 134 and 136. The base member 14 is also installed between the tower members 48*a* and 48*b*, as illustrated in FIG. 6, to further increase the structural integrity of the display. This is accomplished, with reference to FIG. 1, by folding end portions 130 and 132 of the base member about lateral fold lines 134 and 136 so that they lay in planes that are perpendicular to the plane of the remaining portion of the base member. As a result, the base member assumes a generally U-shaped configuration. The end portions 130 and 132 are oriented vertically, with the remaining portion of the base panel laying horizontally on a surface. End portion 130 is then inserted into the bottom of tower member 48*a* so that it is received between the support panel 18*a* and the display panel 10*a*. End portion 132 is likewise inserted into the bottom of tower member 48*b* in a similar fashion. Of course, the base member may be installed between the tower members before the bridge member is installed.

With reference to FIG. 6, goods that are to be sold, for example, cases of soda or other beverages, are stacked between the tower members so that they rest on base member 14 and are positioned beneath bridge member 20. As a result, in addition to increasing the structural rigidity of the display, base member also protects the floor of the store or other establishment under the display.

As illustrated in FIGS. 2 and 5, bridge member 20 features lateral fold lines 142 and 144 so that the length of bridge member 20 may be adjusted depending on the amount of merchandise stacked between the tower members 48*a* and 48*b* of FIG. 6. More specifically, for a shorter distance between the tower members, the bridge member may be folded about fold line 144 (FIGS. 2 and 5) so that the portion between fold line 144 and the end of the bridge member overlays the portion between fold lines 142 and 144. To make bridge member 20 even shorter, it may be folded about both fold lines 142 and 144 so that both portions overlay part of the remaining portion of the bridge member. As illustrated in FIG. 1, base member 14 features lateral fold lines 146 and 148 so that it may also accommodate decreased distances between the tower members.

The present invention therefore offers a display that is eye-catching from a 180° viewing angle and stable when assembled. The display also features components that each may be folded into flat and compact configurations for each of storage and shipping. The display is also quickly and easily assembled. The display is also flexible in terms of accommodating various quantities of merchandise for display.

While the preferred embodiments of the invention have been shown and described, it will be apparent to those skilled in the art that changes and modifications may be made therein without departing from the spirit of the invention, the scope of which is defined by the appended claims.

What is claimed is:

1. A folding display comprising:

a) a display panel having a front surface and a back surface;

b) a support panel featuring a pair of side tabs with a first flap positioned between the side tabs, said first flap having an arcuate edge;

c) said side tabs of the support panel secured to the back surface of the display panel and said first flap of the support panel movable to a position where the arcuate edge of the first flap engages the back surface of the display panel so that the display panel is placed in a convex configuration; and d) said display panel and said support panel each having a first lateral fold line with the first lateral fold lines overlaying one another so that the display and support panels may be simultaneously folded about the first lateral fold lines; and e) a bridge member having a panel with a tab extending therefrom, wherein the first flap of the support panel has a slot formed therein, said slot sized to receive the tab of the bridge member.

2. The folding display of claim 1 further comprising a second flap formed in the support panel and positioned between the side tabs and in spaced relation to the first flap, said second flap having an arcuate edge and movable to a position where the arcuate edge engages the back surface of the display panel.

3. The folding display of claim 1 wherein the display panel and support panel each have a second lateral fold line in spaced relation with the first lateral fold lines and with the second lateral fold lines overlaying one another so that the display and support panels may be simultaneously folded about the second lateral fold lines.

4. The folding display of claim 3 wherein the first and second lateral fold lines of the support panel are slits.

5. The folding display of claim 1 further comprising advertising indicia printed on the front surface of the display panel.

6. The folding display of claim 1 wherein the display panel features a whimsical shape.

7. The folding display of claim 1 further comprising a finger hole formed in the first flap.

8. The folding display of claim 1 wherein the display panel is made of cardboard.

9. The folding display of claim 1 wherein the support panel is made of corrugated cardboard.

10. The folding display of claim 9 wherein the first lateral fold line of the support panel is a slit.

11. The folding display of claim 1 wherein the support panel includes a back portion and a pair of side portions, said side portions positioned one each between the back portion and one each of the side tabs with longitudinal fold lines separating the back and side portions and the side portions and tabs.

12. A display comprising:

a) a pair of tower members positioned in a spaced relation;

b) a bridge member engaging the tower members so as to span there between;

c) a base member positioned upon a surface upon which the display is supported and engaging each of the tower members; and d) each of said tower members including, a support panel and a display panel attached thereto, each of said support panels including a flap, each flap including a slot and an arcuate edge with said flap oriented in a generally horizontal plane so that the arcuate edge engages the display panel and places it in a convex configuration, wherein the bridge member is supported on opposing ends by the flaps of the tower members and the bridge member includes tabs that engage the slots of the flaps.

13. The display of claim 12 wherein the support panels and bridge member are constructed from a first single sheet of material and the display panels and base panel are constructed from a second single sheet of material.

14. The display of claim 13 wherein the first single sheet of material is corrugated cardboard and the second single sheet of material is cardboard.

* * * * *